US008511129B2

(12) United States Patent
Tamai et al.

(10) Patent No.: US 8,511,129 B2
(45) Date of Patent: Aug. 20, 2013

(54) PRESS FORMING METHOD FOR METAL SHEET AND FRAME PART FOR AUTOMOTIVE BODY MANUFACTURED THEREBY

(75) Inventors: Yoshikiyo Tamai, Tokyo (JP); Yuji Yamasaki, Tokyo (JP); Akihide Yoshitake, Tokyo (JP)

(73) Assignee: JFE Steel Corporation (JP)

( * ) Notice: Subject to any disclaimer, the term of this patent is extended or adjusted under 35 U.S.C. 154(b) by 696 days.

(21) Appl. No.: 12/444,185

(22) PCT Filed: Jan. 22, 2007

(86) PCT No.: PCT/JP2007/051319

§ 371 (c)(1),
(2), (4) Date: Apr. 3, 2009

(87) PCT Pub. No.: WO2008/053604

PCT Pub. Date: May 8, 2008

(65) Prior Publication Data

US 2010/0071434 A1 Mar. 25, 2010

(30) Foreign Application Priority Data

Oct. 31, 2006 (JP) ..... 2006-296682

(51) Int. Cl.
*B21D 22/00* (2006.01)

(52) U.S. Cl.
USPC ..... 72/350; 72/348; 72/347; 72/42

(58) Field of Classification Search
USPC ..... 72/41, 42, 347, 348, 350
See application file for complete search history.

(56) References Cited

U.S. PATENT DOCUMENTS

| | | | | | |
|---|---|---|---|---|---|
| 2,308,471 | A | * | 1/1943 | Schwartz | 72/331 |
| 3,421,466 | A | * | 1/1969 | Hess | 72/351 |
| 3,769,824 | A | * | 11/1973 | Granzow | 72/41 |
| 4,416,132 | A | * | 11/1983 | Sargent | 72/41 |
| 4,472,955 | A | * | 9/1984 | Nakamura et al. | 72/57 |
| 4,485,663 | A | * | 12/1984 | Gold et al. | 72/347 |

(Continued)

FOREIGN PATENT DOCUMENTS

| | | | |
|---|---|---|---|
| JP | 2000-017285 | A | 1/2000 |
| JP | 2002-066659 | A | 3/2002 |

(Continued)

OTHER PUBLICATIONS

26th Edition, Machinery's Handbook, industrial press inc, copyright 2000, ISBN 0-833-2666-3.*

(Continued)

*Primary Examiner* — Dana Ross
*Assistant Examiner* — Lawrence Averick
(74) *Attorney, Agent, or Firm* — DLA Piper LLP (US)

(57) ABSTRACT

A press forming method for a metal sheet uses dies, a surface roughness of which is an arithmetical mean roughness Ra of 7.5 μm or smaller, which are used as a punch, an upper die, and a blank holder. Fluid with a kinematic viscosity of 500 $mm^2/s$ or lower is supplied to a space between a metal sheet and the blank holder, a space between the metal sheet and the punch, and a space between the metal sheet and the upper die. A die is detached from a workpiece in the middle of forming, and resuming the forming.

12 Claims, 11 Drawing Sheets

(56) References Cited

U.S. PATENT DOCUMENTS

| | | | | |
|---|---|---|---|---|
| 4,530,228 | A * | 7/1985 | Snyder et al. | 72/349 |
| 4,562,715 | A * | 1/1986 | Brun et al. | 72/167 |
| 4,663,956 | A * | 5/1987 | Brun et al. | 72/167 |
| 4,863,333 | A * | 9/1989 | Kaminski | 413/69 |
| 4,876,876 | A * | 10/1989 | Ishida et al. | 72/348 |
| 5,014,536 | A * | 5/1991 | Saunders | 72/349 |
| 5,181,409 | A * | 1/1993 | Heyes et al. | 72/46 |
| 5,347,839 | A * | 9/1994 | Saunders | 72/347 |
| 5,367,903 | A * | 11/1994 | Keller | 72/42 |
| 5,433,099 | A * | 7/1995 | Katsuhiro et al. | 72/347 |
| 5,544,517 | A * | 8/1996 | Shimizu | 72/349 |
| 5,647,242 | A * | 7/1997 | Saunders | 72/349 |
| 5,755,129 | A * | 5/1998 | Yamasaki | 72/57 |
| 5,768,932 | A * | 6/1998 | Hahn | 72/348 |
| 5,950,468 | A * | 9/1999 | Shimizu et al. | 72/41 |
| 6,305,210 | B1 * | 10/2001 | Saunders et al. | 72/348 |
| 6,673,164 | B2 * | 1/2004 | Rasouli et al. | 148/243 |
| 6,802,197 | B2 * | 10/2004 | Barrera | 72/267 |
| 6,807,838 | B2 * | 10/2004 | Iwaya | 72/350 |
| 7,334,447 | B1 * | 2/2008 | Kulkarni et al. | 72/350 |
| 7,845,204 | B2 * | 12/2010 | Smyers et al. | 72/349 |
| 7,886,564 | B2 * | 2/2011 | Suzuki et al. | 72/14.9 |
| 2003/0046971 | A1 * | 3/2003 | Enoki | 72/348 |
| 2007/0175258 | A1 * | 8/2007 | Bowen | 72/347 |
| 2007/0186614 | A1 * | 8/2007 | Pinard | 72/347 |
| 2007/0240479 | A1 * | 10/2007 | Nagai et al. | 72/348 |
| 2009/0100892 | A1 * | 4/2009 | Nardini | 72/347 |
| 2009/0193869 | A1 * | 8/2009 | Gaensbauer et al. | 72/348 |
| 2010/0071431 | A1 * | 3/2010 | Kato et al. | 72/41 |

FOREIGN PATENT DOCUMENTS

| | | | |
|---|---|---|---|
| JP | 2003-103311 | A | 4/2003 |
| JP | 2003-126919 | A | 5/2003 |
| JP | 2005-199318 | A | 7/2005 |
| JP | 2005-199319 | A | 7/2005 |
| JP | 2005-334960 | A | 12/2005 |

OTHER PUBLICATIONS

Tekko Binran IV (Japanese w/English translation), 3rd edition, pp. 251-260, edited by The Iron and Steel Institute of Japan.

Sosei to Kakou (Japanese w/English translation), Journal of The Japan Society for Technology of Plasticity, vol. 39, No. 452, Sep. 1998, pp. 22-26.

* cited by examiner

60: FRONT SIDE FRAME
61: BUMPER
62: COLLISION LOAD INPUT

FIG. 7A

PRIOR ART

BLANK BEFORE START OF PRESS FORMING

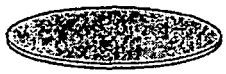

(1) START OF PRESS FORMING

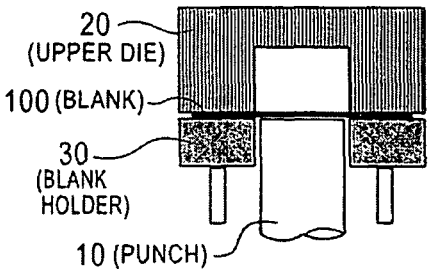

(2) MIDDLE OF PRESS FORMING

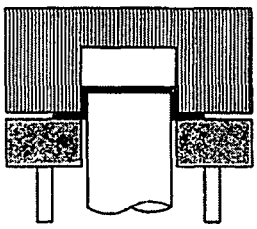

(3) COMPLETION OF PRESS FORMING

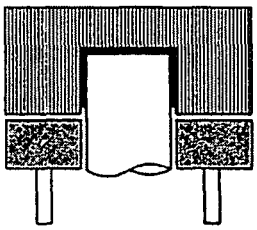

CYLINDRICAL CUP AFTER COMPLETION OF PRESS FORMING

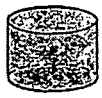

FIG. 7B

PRESENT INVENTION

BLANK BEFORE START OF PRESS FORMING

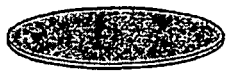

(1) START OF PRESS FORMING

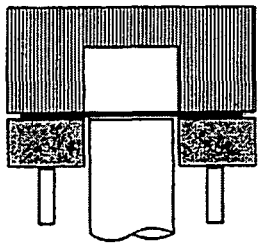

(2) MIDDLE OF PRESS FORMING (DETACH UPPER DIE FROM BLANK)

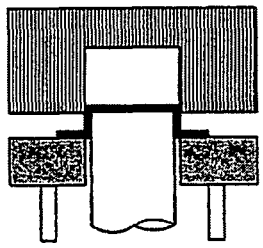

(3) COMPLETION OF PRESS FORMING (RESUME FORMING)

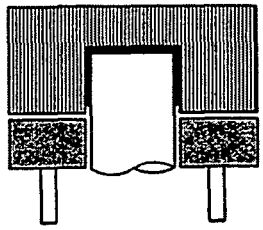

CYLINDRICAL CUP AFTER COMPLETION OF PRESS FORMING

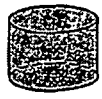

LIMIT DRAWING RATIO (LDR) = D/d

PRESS FORMING METHOD FOR METAL SHEET AND FRAME PART FOR AUTOMOTIVE BODY MANUFACTURED THEREBY

RELATED APPLICATIONS

This is a §371 of International Application No. PCT/JP2007/051319, with an international filing date of Jan. 22, 2007 (WO 2008/053604 A1, published May 8, 2008), which is based on Japanese Patent Application No. 2006-296682, filed Oct. 31, 2006.

TECHNICAL FIELD

Press forming is forming a metal sheet into a desired shape while the metal sheet is held by a set of dies (in many cases, metal dies), such as a punch and an upper die. This disclosure relates to press forming methods for metal sheets to manufacture parts or the like for automotive bodies such as automobiles. More specifically, the disclosure relates to a press forming method for a metal sheet, the method particularly called drawing. The method improves a forming limit at which a crack appears in the metal sheet, without taking any special measure such as correcting the shape of dies (grinding or the like) or changing the material of the metal sheet to a special material. Also, the disclosure relates to frame parts for automotive bodies applied to frame structures, the frame parts manufactured by the press forming methods using a metal material with a tensile strength of 400 MPa or higher as a blank.

BACKGROUND

Referring to FIGS. 9A and 9B, press forming includes, for example, drawing and stretching. FIG. 9A is an example of drawing. A material metal sheet (referred to as blank) 100 is arranged into a die (upper die 20) from the periphery. FIG. 9B is an example of stretching. A draw bead 40 is provided so that a material metal sheet (blank) 100 is not arranged into the die (20) (Tekko Binran IV (Japanese), 3rd edition, pp. 252 and 259, edited by The Iron and Steel Institute of Japan). FIGS. 10A and 10B show a definition of a limit drawing ratio LDR described in the same document. Formability improves as the limit drawing ratio increases. In FIGS. 10A and 10B, reference humeral 10 denotes a punch which defines dies together with the upper die 20, and 30 denotes a blank holder.

As shown in FIG. 11A, hitherto, press forming has been typically performed by moving a punch 10 of an upper die 20 in a forming progress direction (in a direction in which a forming height increases) so that, for example, a material metal sheet 100 is formed by the upper die 20 located at an upper side in the figure and the punch 10 rising from a lower side in the figure until the shape of the material metal sheet (blank) 100 achieves a final target shape (the punch 10 reaches a top dead center). (Alternatively, a die 20 may be located at the lower side and a punch 10 may be located at the upper side. In this case, forming is completed when the punch 10 reaches a bottom dead center.) During the forming, in many cases, a blank holder 30 is arranged, and the forming is completed by moving the punch 10 while the metal sheet (blank 100) is held between the blank holder 30 and the upper die 20, to prevent a wrinkle from appearing at an outer edge of the blank 100.

A force of holding the metal sheet (blank 100) between the blank holder 30 and the upper die 20 is enough as long as the force prevents a wrinkle from appearing at the outer edge of the blank 100, and the force does not have to be excessively large. In the case of drawing in FIG. 9A, the metal sheet (blank 100) held between the blank holder 30 and the upper die 20 is drawn into a deep side of the upper die 20 while the metal sheet slides on the blank holder 30 and the upper die 20. Hence, if a blank holding force is excessively large, sliding may be inhibited, resulting in a crack likely appearing in the metal sheet (blank 100) during press forming. In the case of stretching in FIG. 9B, the draw bead 40 positively inhibits the metal sheet (blank 100) from sliding and prevents the metal sheet (blank 100) from being drawn into the deep side of the upper die 20.

Meanwhile, many types of forming defects may occur during press forming. In particular, when a part for press forming has a complicated shape or a material metal sheet (blank) have a high strength, a crack likely appears in the blank.

A typical method to prevent, the above problem may be, for example, correcting the shape of press forming dies (also simply referred to as dies) such as a punch and an upper die, changing the shape of a blank from its original shape, or changing the material of the blank to a special material.

However, applying the method of correcting the shape of the dies, or changing the shape or material of the blank requires a long time, a large amount of labor, and a high cost. Thus, a method of preventing a crack not relying upon the above method has been studied and developed.

Japanese Unexamined Patent Application Publication No. 2005-199318 discloses a method including, after a punch first contacts a metal sheet (blank) and forming is started, and before the punch reaches a stroke end and the forming is completed, detaching the punch from the metal sheet (blank), and resuming the forming of the metal sheet (blank) using the punch and an upper die.

Japanese Unexamined Patent Application Publication No. 2005-199319 discloses a method including, after a punch first contacts a metal sheet (blank) and forming is started, and before the punch reaches a stroke end and the forming is completed, detaching a blank holder from the metal sheet (blank), and resuming the forming of the metal sheet (blank) using the punch, an upper die, and the blank holder.

With the method of detaching the punch from the blank and resuming the forming of the metal sheet as disclosed in Japanese Unexamined Patent Application Publication No. 2005-199318, a lubricant flows again immediately after the punch is detached from the blank, and hence sliding performance is improved. This acts on improvement of formability. However, the action may be affected by the surface roughness of the dies or the type (kinematic viscosity) of the lubricant. The action may not be sufficiently obtained depending on the surface roughness of the dies and the kinematic viscosity of the lubricant to be used. An improvement has been desired.

The method of detaching the blank holder from the blank and resuming the forming of the metal sheet as disclosed in Japanese Unexamined Patent Application Publication No. 2005-199319 is in a similar situation. A lubricant flows again immediately after the blank holder is detached from the blank, and hence sliding performance is improved. This acts on improvement of formability. However, the action may be affected by the surface roughness of the dies or the type (kinematic viscosity) of the lubricant. The action may not be sufficiently obtained depending on the surface roughness of the dies and the kinematic viscosity of the lubricant to be used. An improvement has been desired.

It could therefore be helpful to provide a method capable of improving a forming limit at which a crack appears in a metal sheet and being easily applied to a large press machine for mass production with a low cost, without correcting the shape of dies, such as a punch and an upper die, or changing the shape or material of a blank to a special shape or material, even when the shape of a part for press forming has a complicated shape or a material metal sheet has a high strength.

It could also be helpful to provide a frame part for an automotive body manufactured by the press forming method and having excellent energy absorbability.

SUMMARY (1) We provide a press forming method for a metal sheet, in which a blank holder is arranged, and the metal sheet is held by a punch and an upper die. The method includes the step of performing an operation at least one time, the operation including, after the punch first contacts the metal sheet and forming is started while the metal sheet is held by the blank holder and the upper die, and before the punch reaches a stroke end and the forming is completed, detaching the blank holder from the metal sheet, and resuming the forming of the metal sheet using the punch, the upper die, and the blank holder. Dies, a surface roughness of which is an arithmetical mean roughness Ra of 7.5 μm or smaller, are used as the punch, the upper die, and the blank holder. Fluid with a kinematic viscosity of 500 $mm^2/s$ or lower (40° C.), as a lubricant, is supplied to a space between the metal sheet and the blank holder, a space between the metal sheet and the punch, and a space between the metal sheet and the upper die.

(2) We also provide a press forming method for a metal sheet, in which a blank holder is arranged, and the metal sheet is held by a punch and an upper die. The method includes the step of performing an operation at least one time, the operation including, after the punch first contacts the metal sheet and forming is started while the metal sheet is held by the blank holder and the upper die, and before the punch reaches a stroke end and the forming is completed, detaching the punch from the metal sheet, and resuming the forming of the metal sheet using the punch, the upper die, and the blank holder. Dies, a surface roughness of which is an arithmetical mean roughness Ra of 7.5 μm or smaller, are used as the punch, the upper die, and the blank holder. Fluid with a kinematic viscosity of 500 $mm^2/s$ or lower (40° C.), as a lubricant, is supplied to a space between the metal sheet and the blank holder, a space between the metal sheet and the punch, and a space between the metal sheet and the upper die.

(3) We further provide a press forming method for a metal sheet, in which a blank holder is arranged, and the metal sheet is held by a punch and an upper die. The method includes the step of performing an operation at least one time, the operation including, after the punch first contacts the metal sheet and forming is started while the metal sheet is held by the blank holder and the upper die, and before the punch reaches a stroke end and the forming is completed, detaching the upper die from the metal sheet, and resuming the forming of the metal sheet using the punch, the upper die, and the blank holder.

(4) We yet further provide a press forming method for a metal sheet, in which a blank holder is arranged, and the metal sheet is held by a punch and an upper die. The method includes the step of performing an operation at least one time, the operation including, after the punch first contacts the metal sheet and forming is started while the metal sheet is held by the blank holder and the upper die, and before the punch reaches a stroke end and the forming is completed, detaching the blank holder from the metal sheet, detaching the metal sheet from the upper die using a tool, and resuming the forming of the metal sheet using the punch, the upper die, and the blank holder.

(5) The method according to any of (1) to (4) also includes a metal sheet with a tensile strength of 400 MPa or higher which is press-formed.

(6) The method according to (5) provides a frame part for an automotive body which is press-formed.

The press forming method is capable of improving a forming limit at which a crack appears in a metal sheet and is easily applied to a large press machine for mass production with a low cost, without correcting the shape of dies, such as a punch and an upper die, or changing the shape or material of a blank to a special shape or material. Also, using the press forming method, the frame part for an automotive body can be provided, the part using a metal sheet with a tensile strength of 400 MPa or higher as its blank and having excellent energy absorbability.

BRIEF DESCRIPTION OF THE DRAWINGS

FIGS. 7A and 7B are illustrations showing our method of detaching an upper die in the middle of forming.

Figure 1:
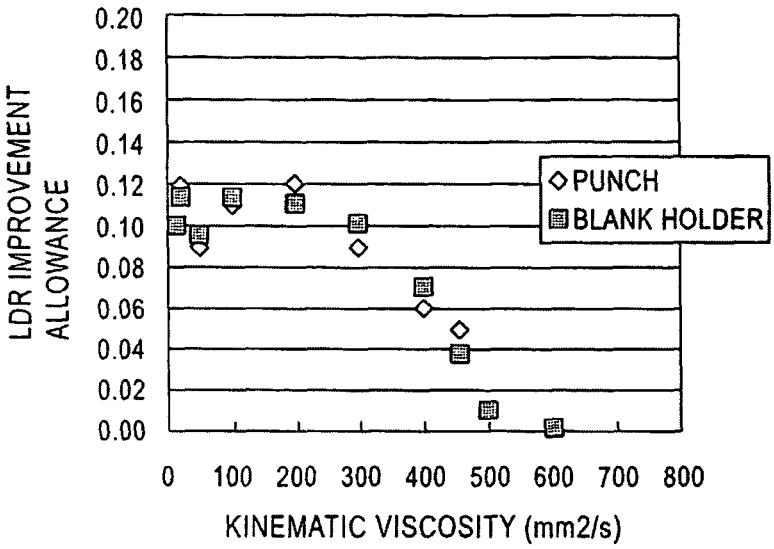
FIG. 1 is an illustration showing an example relationship between the kinematic viscosity of a lubricant and the LDR improvement allowance to describe the principle of our method.

Reference numerals in the figures denote components as follows:

| | |
|---|---|
| 10 | punch |
| 20 | upper die |
| 30 | blank holder |
| 40 | draw bead |
| 50 | lubricant |
| 60 | front side frame |
| 61 | bumper |
| 62 | collision load input |

-continued

| Reference numerals in the figures denote components as follows: | |
|---|---|
| 70 | blank extracting tool |
| 100 | blank (material metal sheet). |

DETAILED DESCRIPTION

An action of our method is described with reference to an example of cylindrical cup drawing shown in FIGS. 11A and 11B. The cylindrical cup drawing is popular as a test method for evaluating deep drawability of a material metal sheet (blank). A circular blank is formed into a cylindrical cup with a desired size by drawing. A maximum size (diameter) of a circular blank before start of press forming, which is formable without breaking, cracking, or wrinkling, is evaluated as a forming limit.

Figure 11A:
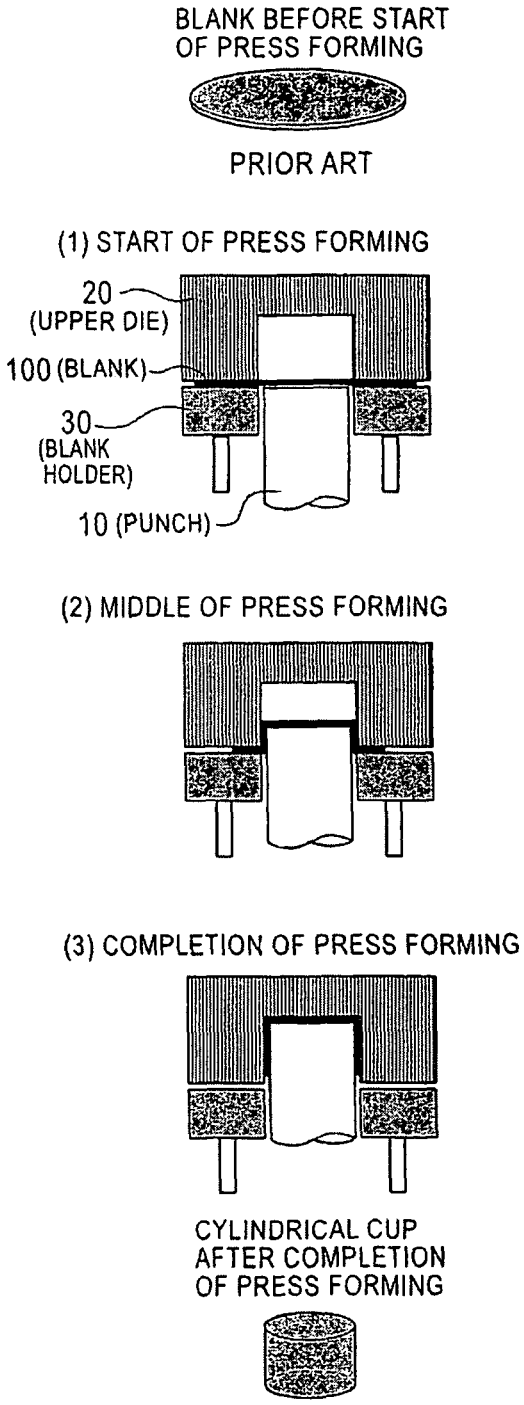
FIGS. 11A and 11B are illustrations showing a method of detaching a blank holder in the middle of forming.

Referring to FIG. 11A, in the conventional method, a blank 100 is held by an upper die 20 located at an upper side in the figure and a blank holder 30, and a blank holding force is applied. Then, forming is started when a punch 10 first contacts the blank 100. The punch 10 moves in a direction until the punch reaches a stroke end and the forming of a metal sheet (blank 100) is completed, i.e., until the punch 10 reaches a forming completion expected position. The forming is completed while the blank holder 30 and the blank 100 are in contact with each other from the start to completion of the forming.

Figure 11B:
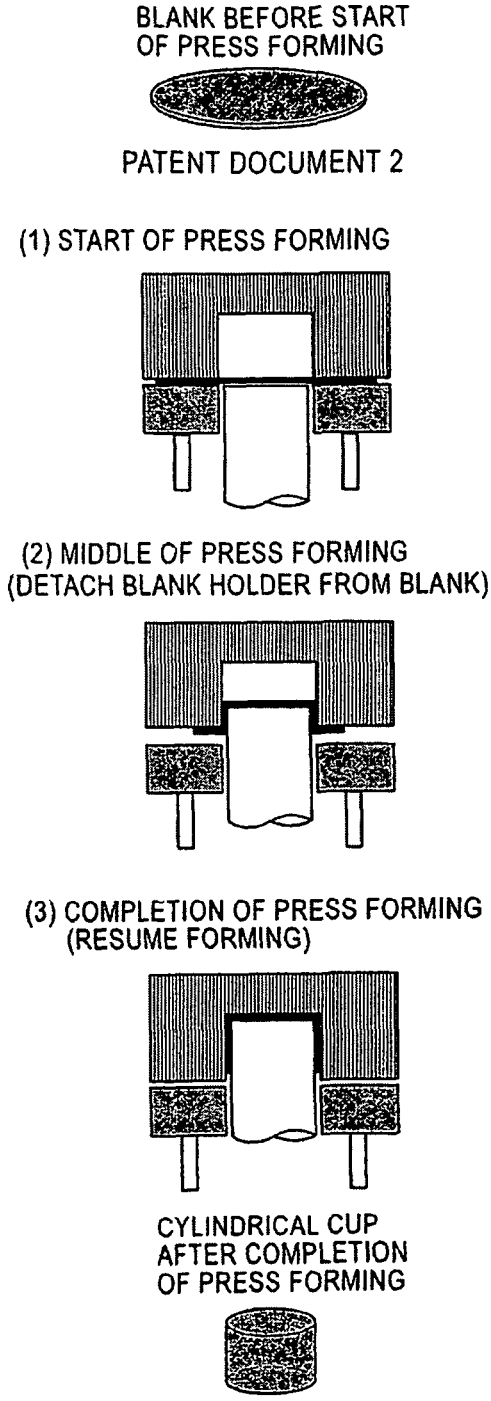

In contrast, referring to FIG. 11B, in the method of Japanese Unexamined Patent Application Publication No. 2005-199319, after a punch 10 first contacts a blank 100 and forming is started, and before the punch reaches a stroke end and the forming of a metal sheet (blank 100) is completed, a blank holder 30 is detached from the metal sheet (blank 100), and the forming of the metal sheet (blank 100) is resumed using the same punch 10, an upper die 20, and the blank holder 30.

We found that, with our method, the deep drawability is improved and the forming limit is improved in a manner similar to that of the method of Japanese Unexamined Patent Application Publication No. 2005-199319. Also, we found that the forming limit is reliably improved by setting the surface property of dies and the kinematic viscosity of a lubricant to optimal values.

Figure 12:
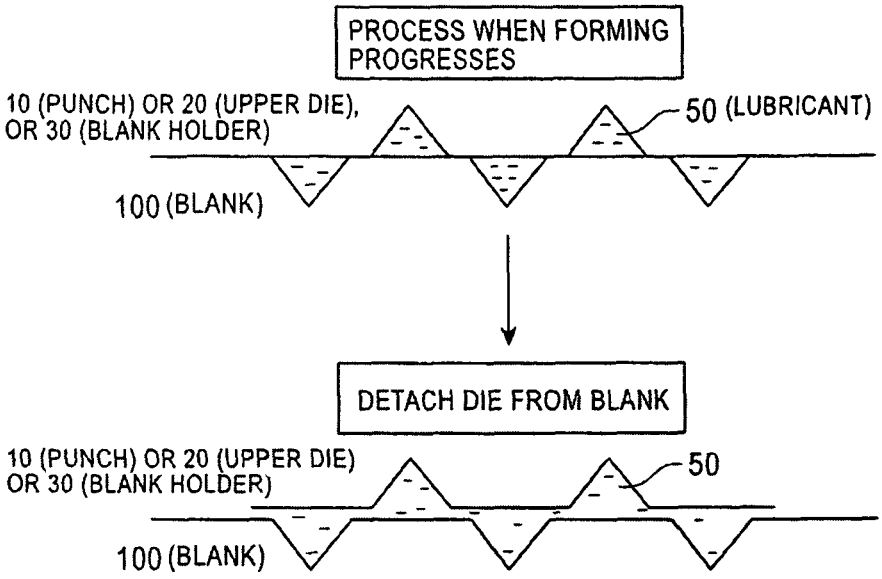
FIG. 12 is an illustration showing an expected action when a punch, an upper die, or a blank holder is detached.

We expected the action of improving the deep drawability by detaching the blank holder from the blank and then, resuming the forming of the blank, as follows. Regarding the condition in the middle of forming, the surface of the blank 100 slides on the surfaces of the dies, such as the blank holder 30 and the upper die 20 with pressure. Hence, a film of a lubricant 50 present between the blank holder 30 and the blank 100 or between the upper die 20 and the blank 100 at the start of forming temporarily becomes thin while the forming progresses. Thus, metal portions partly directly contact with each other as shown in an upper section of FIG. 12.

A frictional coefficient between the dies (such as the blank holder 30 and the upper die 20) and the blank 100 temporarily increases. Accordingly, a crack may appear in the blank 100 because sliding performance decreases, and a trouble like die galling may occur because the dies adhere to the blank 100. In general, when forming is performed in a situation in which a sliding distance between the dies and the blank 100 is long, such forming defect likely appears. With regard to the practical fact, the above expectation is considered correct.

In light of this, a blank holder 30 is detached from a blank 100 before a punch reaches a stroke end and forming of a metal sheet (blank 100) is completed. Accordingly, as shown in a lower section of FIG. 12, the film thickness of the lubricant 50 is recovered. When an operation is executed such that the same blank holder 30 is used for resuming the forming of the metal sheet (blank 100), the sliding performance is recovered, and thus, a crack or die galling may be prevented from appearing in the blank 100.

It has been found through experimental studies that the surface properties of the dies and the kinematic viscosity of the lubricant, which is fluid affects the above-described film thickness recovery of the lubricant. It has been found that the advantage is not sufficiently attained under a certain condition.

For example, if the surface roughness of dies is as rough as an arithmetical mean roughness Ra exceeding 7.5 μm, it has been experimentally found that the advantage of improving the sliding performance is small when the die is detached from a blank.

The reason is expected such that since irregularities of the surface of the die are large, the lubricant is not held in recesses, and the film thickness is not recovered when the die is detached. Similarly, if the kinematic viscosity of the lubricant is as high as a kinematic viscosity exceeding 500 $mm^2/s$, it has been experimentally found that the advantage of improving the sliding performance is small when the die is detached from the blank.

The reason is expected such that since a lubricant with a high kinematic viscosity has poor fluidity, when a die, such as a punch, an upper die, or a blank holder, is detached, the lubricant is hard to return to the metal surface from the recesses, and the film thickness is not recovered.

In either case, to attain the advantage of our method sufficiently, it is important to select a condition such that the film thickness of the lubricant is reliably recovered when the die, such as the punch, the upper die, of the blank holder, is detached.

Therefore, it is preferable to use dies, the surface roughness of which is an arithmetical mean roughness Ra of 7.5 μm or smaller, for the punch, the upper die, and the blank holder, and it is preferable to apply a lubricant with a kinematic viscosity of 500 $mm^2/s$ or lower.

Figure 13A:
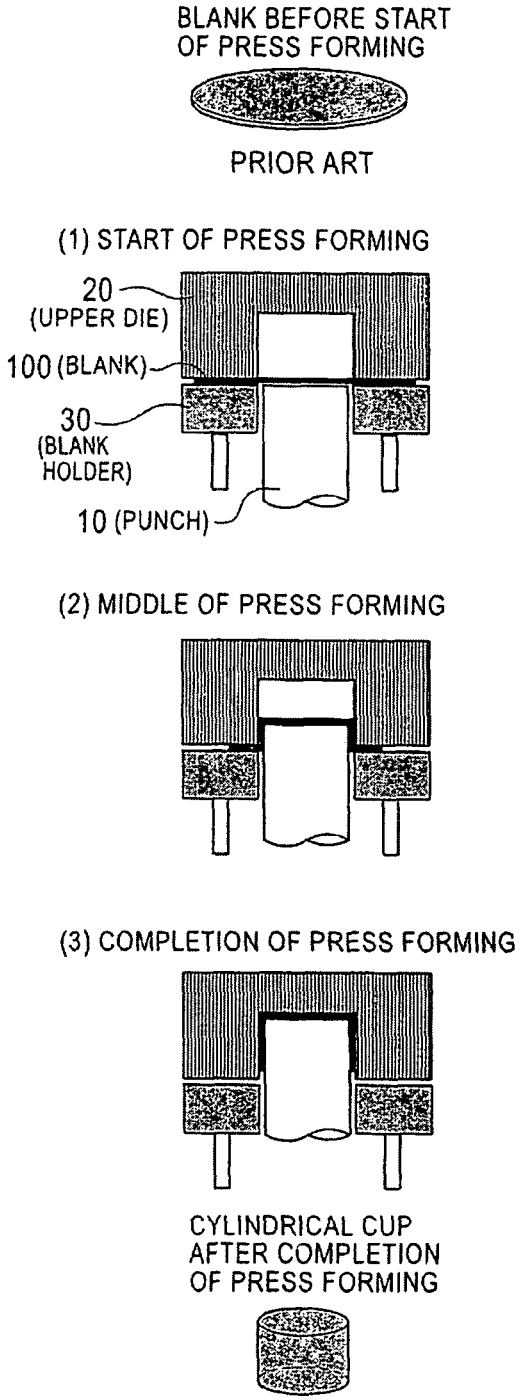
FIGS. 13A and 13B are illustrations showing a method of detaching a punch in the middle of forming.
Figure 13B:
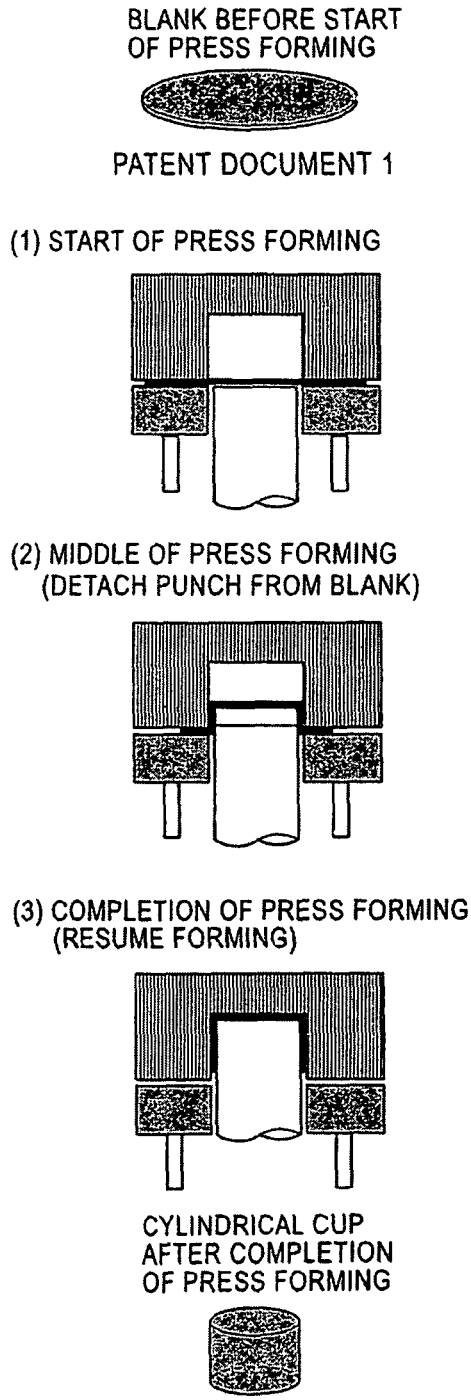

The above-described advantage is attained even when the blank holder is detached from the blank, or when the punch shown in FIG. 13B is detached from the blank (Japanese Unexamined Patent Application Publication No. 2005-199318).

The method effective for improving the formability may be alternatively a method including, after a punch 10 first contacts a blank 100 and forming is started, and before the punch reaches a stroke end and the forming of a metal sheet (blank 100) is completed, detaching an upper die 20 from the metal sheet (blank 100), and resuming the forming of the metal sheet (blank 100) using the same punch 10, the same upper die 20, and a blank holder 30 as shown in FIG. 7B. In particular, in the case of drawing, the blank 100 held between the blank holder 30 and the upper die 20 is bent at a die shoulder and deformed to be unbent, and then enters a space (clearance) between the punch and the upper die. The die shoulder generally has a curvature radius of about 1 to 30 mm. A surface pressure to be applied to the blank wound around the die shoulder typically becomes larger than that of the blank in an area corresponding to the blank holder. Thus, the film thickness of a lubricant between the die and the blank becomes thin at the die shoulder, and metal portions may partly directly contact with each other. This may also cause die galling to likely appear during drawing from the die shoulder as a starting point. Therefore, the recovery of the film thickness of the lubricant between the upper die and the blank is markedly effective for improving drawing formability.

When the upper die is detached from the blank, in some cases, the processed material is subjected to springback, stacked into the upper die, and is not detached from the die. Hence, the advantage is not attained.

Figure 8:
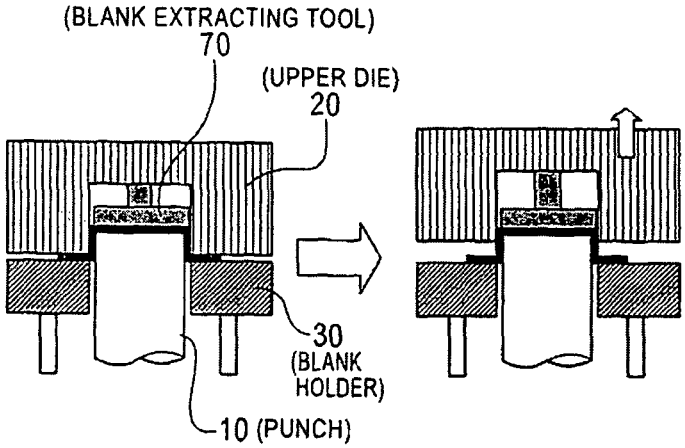
FIG. 8 is an illustration showing a blank extracting mechanism according to our method.
Figure 9A:
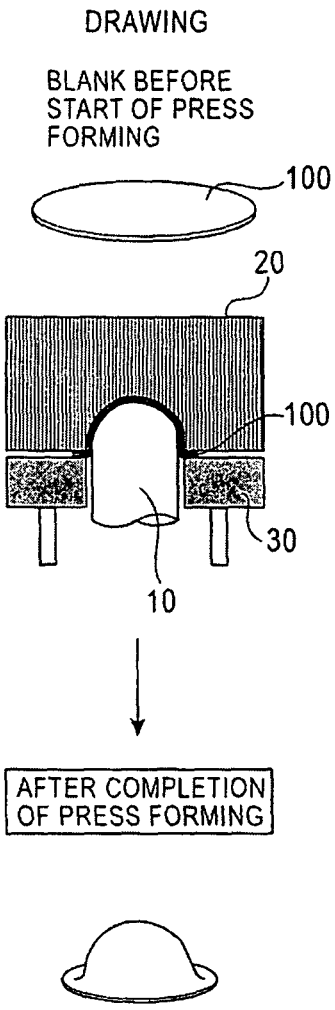
FIGS. 9A and 9B are illustrations showing drawing and stretching.
Figure 9B:
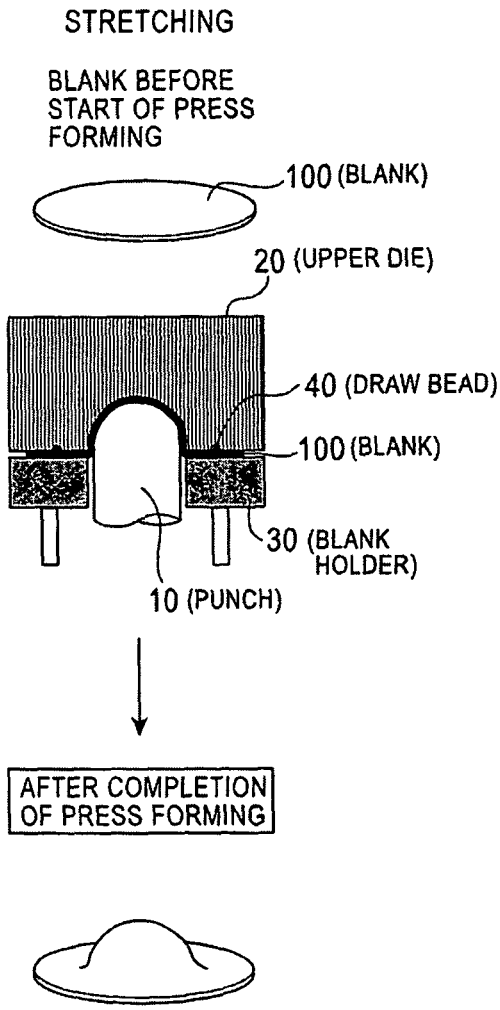
Figure 10A:
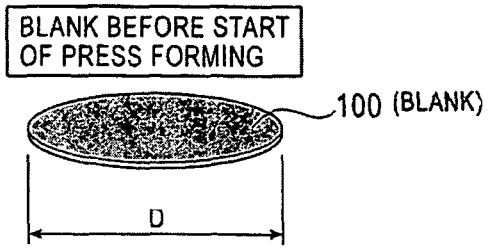
FIGS. 10A and 10B are illustrations showing the limit drawing ratio.
Figure 10B:
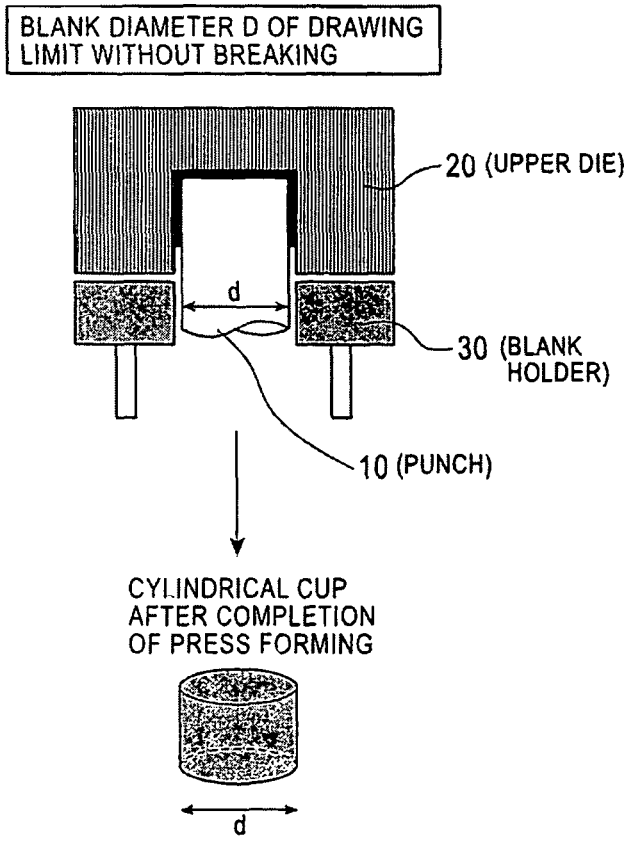

In such a case, a blank extracting tool 70 may be attached to the upper die as shown in FIG. 8, so that a workpiece is extracted when the upper die 20 is detached. A mechanism to generate an extracting force of the workpiece may employ a spring, a hydraulic cylinder, or a pneumatic cylinder. The advantage does hot particularly depend on the mechanism, and any mechanism may be used as long as the workpiece is reliably detached from the upper die.

The advantage can be attained even when these forming methods is solely performed. Alternatively, the punch, the blank holder, and the upper die may be sequentially detached from the blank. For a press panel formed by drawing in which a blank slides on a blank holder surface and stretching using a punch and an upper die, the forming method in which the punch, the blank holder, or the upper die is detached from the blank may be combined with another of our methods. The combination may be selected for each panel depending on the shape of the panel and the forming method. It is more efficient that the advantages of the various forming methods are checked by press trials conducted before mass production is started, and then the forming method to be applied is selected.

Meanwhile, we found that, when frame parts for automotive bodies are press-formed by our forming methods and collision energy absorbability of the frame parts are evaluated, the frame parts have excellent impact absorbability as compared with parts formed by a conventional press method.

We expected the action of improving the impact energy absorbability of the frame parts formed by the above-described forming methods as follows.

The advantage of improving the formability of the above-described forming methods mainly relies upon the recovery of the sliding performance between the dies and the workpiece. Since the sliding performance is recovered, an in-flow resistance of the metal sheet decreases, and a forming load during press forming decreases. Hence, a tensile force acting on a vertical wall portion of the panel during press forming decreases. Thus, the sheet thickness of the vertical wall portion increases as compared with that of a typically formed product. In general, it has been found that the impact absorbed energy of the frame structure part, namely, an absorbed energy E during deformation, a blank tensile strength TS of the part and a sheet thickness t of the part have the following relationship (Japanese Unexamined Patent Application Publication No. 2005-199319):

$$E \propto TS^{a} * t^{b} \quad (1)$$

where a and b are positive constants.

Thus, as the sheet thickness of the member after forming increases, the impact absorbed energy increases, and hence collision safety performance of the automotive body improves. Since the sliding performance in the middle of forming is markedly improved, the sheet thickness of the vertical wall portion increases, and hence the absorbability of the collision energy is improved. Also, since the sheet thickness increases, flexural rigidity and torsional rigidity of the part are improved.

Further, with the method of forming frame parts, the operation of detaching the blank holder 30, the punch 10, or the upper die 20 from the metal sheet (blank 100) and resuming the forming, is repeated. Thus, it has been found that indentations, which are formed during press forming, appear in the vertical wall of the panel formed through drawing by the number corresponding to the number of repetitions of the forming operations.

In the case of typical forming, the indentations appear only in an area near a punch shoulder at the start of forming. Thus, the vertical wall portion is typically flat. In contrast, with the forming method, the indentations appear by the number corresponding to the number of repetitions, and very small steps are formed at the portion.

Since the frame parts have the very small steps (irregularities), it is expected that the part has a higher rigidity than that of the flat vertical wall obtained by typical forming. This is one of factors for improving the energy absorptivity during deformation.

To reduce the weight of the automotive body and improve the collision safety performance, the frame part for the automotive body is typically made of a metal sheet with a tensile strength of 400 MPa or higher. Therefore, our method may be preferably applied to a frame part for an automotive body of an automobile using a metal sheet with a tensile strength of 400 MPa or higher. It is to be noted that our method may be applied to a frame part for vehicles other than the automobile.

EXAMPLE

Example 1

The surface roughness of the punch, upper die, and blank holder, and the kinematic viscosity of the lubricant were changed and forming tests were performed. A cylindrical cup was formed using a cold rolled steel sheet with a tensile strength of about 440 MPa denoted by symbol B as shown in Table 1.

The punch 10 had a diameter of ϕ33 mm, and a shoulder radius of 3 mm. The upper die 20 had a shoulder radius of 5 mm. The evaluation of the forming limit for the cylindrical cup drawing used LDR (limit drawing ratio).

TABLE 1

Mechanical Properties of Samples

| Symbol | Yield strength (MPa) | Tensile strength (MPa) | Elongation (%) | Sheet thickness (mm) |
|---|---|---|---|---|
| A | 151 | 280 | 48 | 1.2 |
| B | 323 | 470 | 32 | 1.2 |
| C | 630 | 1035 | 10 | 1.2 |

Firstly, the forming test was performed using dies, a surface roughness of which is an arithmetical mean roughness Ra of 1.0 μm, and some kinds of lubricants with different kinematic viscosities. Improvement allowance of a limit drawing ratio (increment of LDR as compared with conventional typical forming) when the punch was detached in the middle of forming and when the blank holder was detached in the middle of forming are shown in FIG. 1. It was found that the advantage is not provided if the kinematic viscosity exceeds 500 $mm^2/s$.

Figure 2:
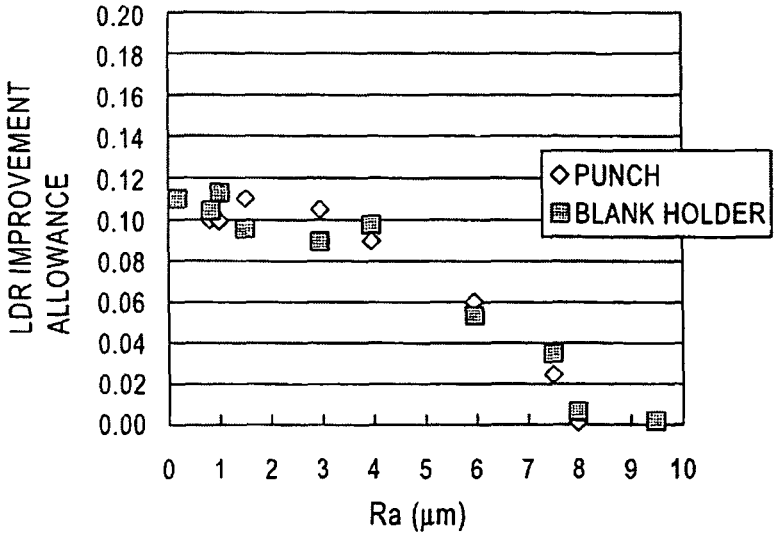
FIG. 2 is an illustration showing an example relationship between the surface roughness of dies and the LDR improvement allowance like FIG. 1.

Then, the forming test was performed using a lubricant with a kinematic viscosity of 20 $mm^2/s$, and the punch, upper die, and blank holder with various surface roughnesses. Improvement allowance of a limit drawing ratio (increment of LDR as compared with conventional typical forming) when the punch was detached in the middle of forming and when the blank holder was detached in the middle of forming are shown in FIG. 2. It was found that the advantage is not provided if the die surface roughness, or the arithmetical mean roughness Ra exceeds 7.5 μm.

Herein, Ra is measured under JIS B 0601-2001, and JIS B 0651-2001. A stylus type surface roughness measuring device was brought into contact with the surface of a sample and measured the surface of the sample while moving in a blank sliding direction with respect to the punch, the upper die, and the blank holder. Roughness parameters, such as a reference length lr (λc) for a roughness curve and a reference length for a sectional curve, i.e., an evaluation length ln were determined under JIS B 0633-2001, representing the measured arithmetical mean roughness Ra. (In particular, when 0.1 μm<Ra≦2 μm, the measurement was made based on lr=0.8 mm and ln=4 mm, and when 2 μm<Ra≦10 μm, the measurement was made based on lr=2.5 mm and ln=12.5 mm.)

Example 2

Press forming was performed using two types of cold rolled steel sheets B and C shown in Table 1. The sample B is a cold rolled steel sheet with a tensile strength as high as 440 MPa. The sample C is a cold rolled steel sheet with a tensile strength as high as 980 MPa.

Figure 3:
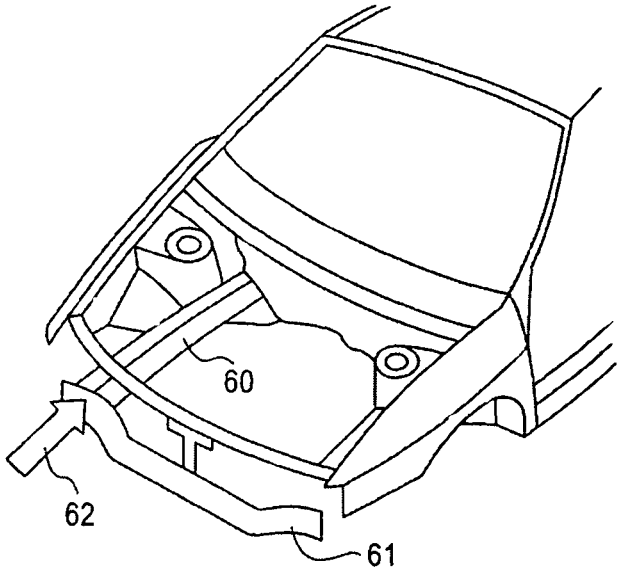
FIG. 3 is a perspective view showing an example front side frame as a frame part for an automotive body, the front side frame being an example of a subject to which our method is applied.

A subject part was a front side frame 60 shown in FIG. 3, which is one of frame parts for automotive bodies. The front side frame 60 is, referring to FIG. 3, a member for absorbing a front collision energy of an automobile (indicated as collision load input) 62. The part should have excellent energy absorbability. In FIG. 3, reference numeral 61 denotes a bumper.

A flat sheet panel was spot-welded to the back surface of a press product obtained by drawing to fabricate a closed section part, and a crush test of the member was performed. A test piece B1 is a part formed by the conventional forming method using the sample B. A test piece B2 is a part formed by our method using the sample B. A test piece C1 is a part formed by the conventional method using the sample C. A test piece C2 is a part formed by our method using the sample C. The mechanical properties of the samples B and C are shown in Table 1.

Figure 4A:
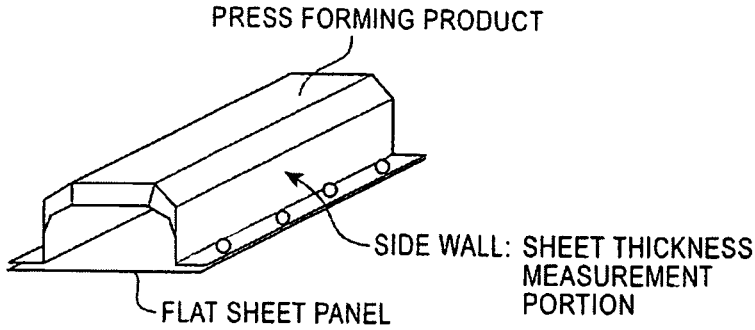
FIGS. 4A and 4B are illustrations showing comparison for measurement examples of sheet thicknesses of press products after forming according to conventional methods and our methods.
Figure 4B:
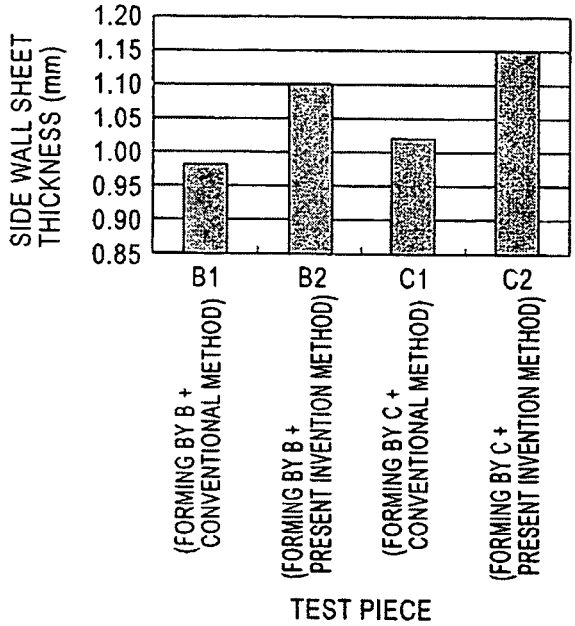

Before the crush test, the sheet thickness of the press product was checked. FIG. 4B shows the result of measurement of the thickness of the vertical wall portion of each part. The measurement point was a center of the vertical wall of the formed product as shown in FIG. 4A. The parts B2 and C2 to which our method was applied had a sheet thickness incremented by about 10% as compared with the parts B1 and C1.

A weight collided with an end surface in an axial direction of each member in a head-on manner with a speed of 50 km/h. A load to be generated was measured by a load cell, and a displacement of a collision edge was measured by a laser displacement gauge, thereby obtaining a load-displacement curve, the curve was used to integrate a load ranging from 0 to 150 mm with the displacement, and an energy amount absorbed by the member before the deformation (crush length in the axial direction) reaches 150 mm was calculated.

Figure 5:
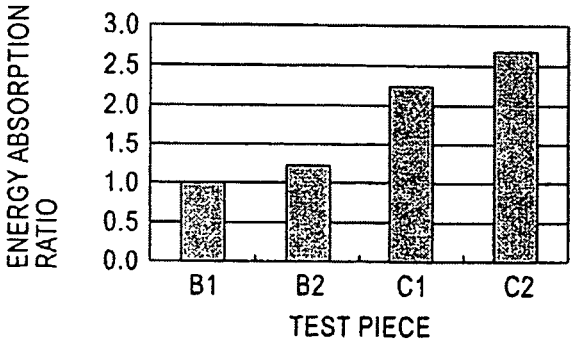
FIG. 5 is an illustration showing comparison for energy absorption ratios of the same examples shown in FIG. 4.

The test result is shown in FIG. 5. It was verified that the energy absorbed amounts of the test pieces B2 and C2 formed by our method were larger than those of the test pieces B1 and C1 formed by the conventional method, by about 20%.

Example 3

Cylindrical cup forming was performed using the three types of cold rolled steel sheets shown in Table 1.

The sample A is a cold rolled steel sheet with a tensile strength as high as 270 MPa. The sample B is a cold rolled steel sheet with a tensile strength as high as 440 MPa. The sample C is a cold rolled steel sheet with a tensile strength as high as 980 MPa.

The punch 10 had a diameter of ϕ33 mm, and a shoulder radius of 3 mm. The upper die 20 had a shoulder radius of 5 mm. The evaluation of the forming limit for the cylindrical cup drawing used LDR (limit drawing ratio).

A die, the surface roughness of which is an arithmetical mean roughness Ra of 1.0 μm, was used, rust preventive oil with a kinematic viscosity of 20 $mm^2/s$ was applied as a lubricant, and the cylindrical cup forming test was performed. The test was performed by the conventional typical forming method, and three types of methods including the forming method in which the punch is detached from the blank in the middle of forming, the forming method in which the blank holder is detached from the blank in the middle of forming, and the forming method in which the upper die is detached from the blank in the middle of forming.

Figure 6A:
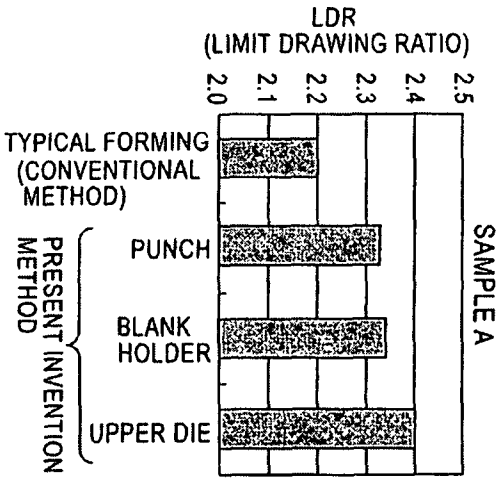
FIGS. 6A, 6B and 6C are illustrations showing comparison for LDRs according to respective forming methods.
Figure 6B:
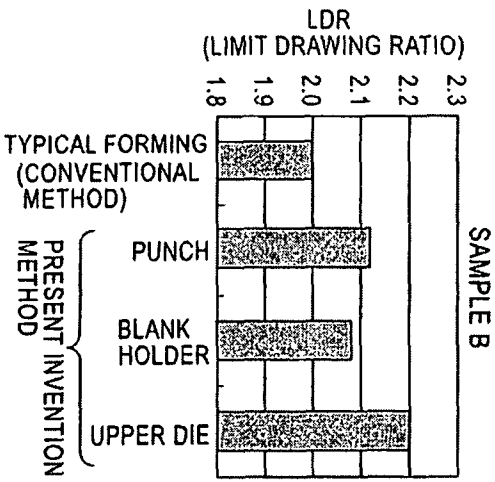
Figure 6C:
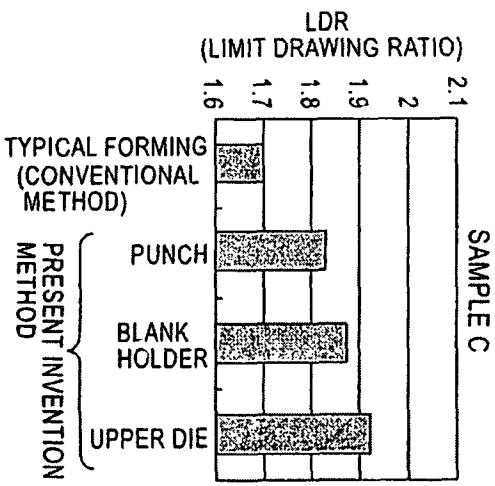

In any method, the timing when the punch, the upper die, of the blank holder is detached from the blank was determined at a position in front of a stroke end by 5 mm. The LDRs through the various forming methods were provided respectively for the samples shown in FIGS. 6A, 6B and 6C. With the application of our method, it has been verified that the limit drawing ratio is improved, and the formability is improved.

In addition, with the forming method of detaching the upper die from the blank, the die shoulder with a high surface pressure, at which metal portions likely contact with each other, is detached. Accordingly, it was found that the advantage of improving the formability with the forming method of detaching the upper die from the blank is further noticeable as compared with the method in which the punch or the blank holder with a relatively low surface pressure is detached.

Industrial Applicability

According to the press forming method for holding the metal sheet by the punch and the upper die, the method can be provided which is capable of improving the forming limit at which a crack appears in a metal sheet and being easily applied to a large press machine for mass production with a low cost, without correcting the shape of dies, such as a punch and an upper die, or changing the shape or material of a blank to a special shape or material, even when the shape of a part for press forming has a complicated shape of a material metal sheet has a high strength.

Also, with the present forming method, by fabricating the frame structure member for the automotive body using the metal sheet with the tensile strength of 400 MPa or higher as a blank, the part can be provided which is excellent in the collision energy absorbability as compared with the conventional member.

The invention claimed is:

1. A method of press forming a metal sheet with a blank holder, a punch and an upper die comprising:

supplying fluid with a kinematic viscosity of 500 $mm^2/s$ or lower (40° C.), as a lubricant, to a space between the metal sheet and the blank holder, a space between the metal sheet and the punch, and a space between the metal sheet and the upper die;

starting forming of the metal sheet by contacting the metal sheet with the punch while the metal sheet is held by the blank holder and the upper die;

before the punch reaches a bottom dead center and forming is completed, in the middle of forming before the punch reaches a stroke end, detaching the blank holder from the metal sheet, wherein the metal sheet remains attached to the punch; and resuming forming of the metal sheet using the same punch, the same upper die, and the same blank holder, wherein dies, a surface roughness of which is an arithmetical mean roughness Ra of 7.5 μm or smaller, are used as the punch, the upper die, and the blank holder.

2. The method according to claim 1, wherein a metal sheet with a tensile strength of 400 MPa or higher is press-formed.

3. A metal sheet press-formed by the method according to claim 2.

4. A method of press forming a metal sheet with a blank holder, a punch and an upper die comprising:

supplying fluid with a kinematic viscosity of 500 $mm^2/s$ or lower (40° C.), as a lubricant, to a space between the metal sheet and the blank holder, a space between the metal sheet and the punch, and a space between the metal sheet and the upper die;

starting forming of the metal sheet by contacting the metal sheet with the punch while the metal sheet is held by the blank holder and the upper die;

before the punch reaches a bottom dead center and forming is completed, in the middle of forming before the punch reaches a stroke end, detaching the punch from the metal sheet, wherein the metal sheet remains attached to the blank holder or the upper die; and resuming forming of the metal sheet using the same punch, the same upper die, and the same blank holder, wherein dies, a surface roughness of which is an arithmetical mean roughness Ra of 7.5 μm or smaller, are used as the punch, the upper die, and the blank holder.

5. The method according to claim 4, wherein a metal sheet with a tensile strength of 400 MPa or higher is press-formed.

6. A metal sheet press-formed by the method according to claim 5.

7. A method of press forming a metal sheet with a blank holder, a punch and an upper die comprising:

starting forming of the metal sheet by contacting the metal sheet with the punch while the metal sheet is held by the blank holder and the upper die;

before the punch reaches a bottom dead center and forming is completed, in the middle of forming before the punch reaches a stroke end, detaching the upper die from the metal sheet, wherein the metal sheet remains attached to the blank holder or the punch; and resuming forming of the metal sheet using the same punch, the same upper die, and the same blank holder.

8. The method according to claim 7, wherein a metal sheet with a tensile strength of 400 MPa or higher is press-formed.

9. A metal sheet press-formed by the method according to claim 8.

10. A method of press forming a metal sheet with a blank holder, a punch and an upper die comprising:

starting forming of the metal sheet by contacting the metal sheet with the punch while the metal sheet is held by the blank holder and the upper die;

before the punch reaches a bottom dead center and forming is completed, in the middle of forming before the punch reaches a stroke end, detaching the blank holder from the metal sheet and detaching upper die from the metal sheet using a tool, wherein the metal sheet remains attached to the punch and resuming forming of the metal sheet using the same punch, the same upper die, and the same blank holder.

11. The method according to claim 10, wherein a metal sheet with a tensile strength of 400 MPa or higher is press-formed.

12. A metal sheet press-formed by the method according to claim 11.

* * * * *